US007861340B2

(12) United States Patent
Barthelt

(10) Patent No.: US 7,861,340 B2
(45) Date of Patent: Jan. 4, 2011

(54) TREATMENT BED WITH BALANCING CIRCUIT

(76) Inventor: Hans-Peter Barthelt, Hegensbergerstr. 132, Esslingen (DE) 73732

( * ) Notice: Subject to any disclaimer, the term of this patent is extended or adjusted under 35 U.S.C. 154(b) by 611 days.

(21) Appl. No.: 11/815,537

(22) PCT Filed: Jan. 13, 2006

(86) PCT No.: PCT/EP2006/000250

§ 371 (c)(1),
(2), (4) Date: Oct. 24, 2007

(87) PCT Pub. No.: WO2006/081925

PCT Pub. Date: Aug. 10, 2006

(65) Prior Publication Data

US 2008/0148485 A1 Jun. 26, 2008

(30) Foreign Application Priority Data

Feb. 4, 2005 (DE) ..... 10 2005 005 471

(51) Int. Cl.
*A61G 7/012* (2006.01)
*A61G 7/018* (2006.01)

(52) U.S. Cl. ..... 5/616; 5/611; 5/600

(58) Field of Classification Search ..... 5/616–618, 5/611, 11, 600; 318/466, 52
See application file for complete search history.

(56) References Cited

U.S. PATENT DOCUMENTS

| | | | | | |
|---|---|---|---|---|---|
| 3,913,153 | A * | 10/1975 | Adams et al. | ..... | 5/616 |
| 4,407,030 | A * | 10/1983 | Elliott | ..... | 5/616 |
| 4,435,862 | A * | 3/1984 | King et al. | ..... | 5/611 |
| 4,769,584 | A * | 9/1988 | Irigoyen et al. | ..... | 318/648 |
| 4,857,813 | A * | 8/1989 | Matsumoto et al. | ..... | 318/54 |
| 6,841,953 | B2 * | 1/2005 | Bastholm | ..... | 318/7 |
| 6,912,746 | B2 * | 7/2005 | Grove | ..... | 5/618 |
| 7,235,942 | B2 * | 6/2007 | Nagaoka et al. | ..... | 318/466 |
| 2002/0195593 | A1 * | 12/2002 | Ardrey, Jr. et al. | ..... | 254/100 |
| 2007/0180620 | A1 * | 8/2007 | Bellingroth | ..... | 5/618 |
| 2008/0148485 | A1 * | 6/2008 | Barthelt | ..... | 5/611 |
| 2010/0146704 | A1 * | 6/2010 | Barthelt | ..... | 5/600 |

* cited by examiner

*Primary Examiner*—Robert G Santos
(74) *Attorney, Agent, or Firm*—Leydig, Voit & Mayer, Ltd.

(57) ABSTRACT

A treatment bed has two lifting motors connected in parallel mechanically in the height-adjustable lifter. In order to load the lifting motors evenly and avoid torsions in the lifter, a balancing circuit that measures the supply currents of the lifting motors is provided. If a difference is determined, then the respective current is briefly interrupted several times until the magnitudes of the currents approach one another.

19 Claims, 5 Drawing Sheets

TREATMENT BED WITH BALANCING CIRCUIT

FIELD OF THE INVENTION

The present invention relates generally to patient treatment beds and more particularly to a balancing circuit for balancing lift motor current during lifting and lowering of a patient treatment bed.

BACKGROUND OF THE INVENTION

DE 10 2004 019 144 describes a treatment bed which has a height-adjustable base located on the mattress frame. With the aid of the height-adjustable base, the mattress frame can be lifted from the normal lowered bed height with the patient lying on it, to a higher level suitable for treatment, making it easier to treat a patient in need of care.

For height adjustment, the treatment bed of DE 10 2004 019 144 has an electric motor which drives a threaded spindle via a worm gear. The threaded spindle extends between the foot of the base and its top, in order to extend the lifter of the base to the appropriate height. The drive is self-locking. The electric motor itself is a low-voltage DC motor. The supply voltage is about 24 V DC.

Patients having less than a design-limited maximum body weight can be raised and lowered with beds such as the bed of DE 10 2004 019 144. The maximum body weight limit is a result of the limited lifting power of the electric motor that is used. The present invention allows a treatment bed that is able to raise and lower patients with a higher body weight.

OBJECTS AND SUMMARY OF THE INVENTION

The treatment bed according to the invention has a height-adjustable base. Two electric motors, which work in parallel, are provided for the vertical adjustment of the base. Since these electric motors are self-locking due to the threaded spindle drive, torsions that damage the bed and the motors can occur if no countermeasures are taken. Moreover, because of the stiffness of the lifting mechanism of the base, small path differences of the electric motors are sufficient to cause such damage.

In order to prevent this, a balancing circuit is provided for the treatment bed according to the invention. The balancing circuit measures the current input to the two electric motors, e.g., during the lifting operation. If the difference between the two currents exceeds a given amount, the current for the motor having the higher current consumption during the measurement is subsequently interrupted briefly for a constant, predetermined time.

Thus it is ensured that the two motors draw about the same current, which ensures that both motors produce roughly the same force for raising the patient. In this way, torsional forces arising from one motor running ahead of the other motor are avoided. Otherwise, the motor that is further ahead is forced not only to lift the patient's weight, but also to work against the lagging motor.

It is advantageous if the treatment bed is further improved in such a manner that the balancing circuit measures the current input not only during lifting, but also during lowering. During lowering the lagging motor typically exhibits a larger current draw because it is not supported. Therefore, it is advantageous in this situation that the power supply to that motor which shows the smaller power input be interrupted.

However, in an embodiment of the invention balancing circuit is adaptive because in some cases the current relationships discussed above may be reversed and the foregoing current corrections would actually increase the problem. Thus, if the balancing circuit determines that the current difference is larger rather than smaller after the interruption of power, it will interrupt the power to the other motor and subsequently only perform the interruption of power for that motor.

Since the measurement and adjustment process is executed continually, a steady state situation will develop after a relatively short time in which the two currents are practically the same.

In order that the brief interruption of power does not hamper the operation or lead to unnecessary control swings, in an embodiment of the invention a tolerance window is defined for the differences of the motor currents. The power is switched off only if the difference goes outside the tolerance window.

In a further embodiment of the invention, the tolerance window is a function of the magnitude of the current. The best values for use in any specific situation are easily determined empirically, as they depend on the precise construction and placement of the motors and the construction of the bed.

Refinements of the invention in other respects are the subject matter of the dependent claims.

When reading the description of the figures it will become clear to the person skilled in the art that a number of modifications originating from the respective conditions are possible. Further combinations are also conceivable, which cannot be presented in all permutations without unnecessarily increasing the length of the description.

Other objects and advantages of the invention will become apparent upon reading the following detailed description and upon reference to the drawings, of which:

Figure 1:
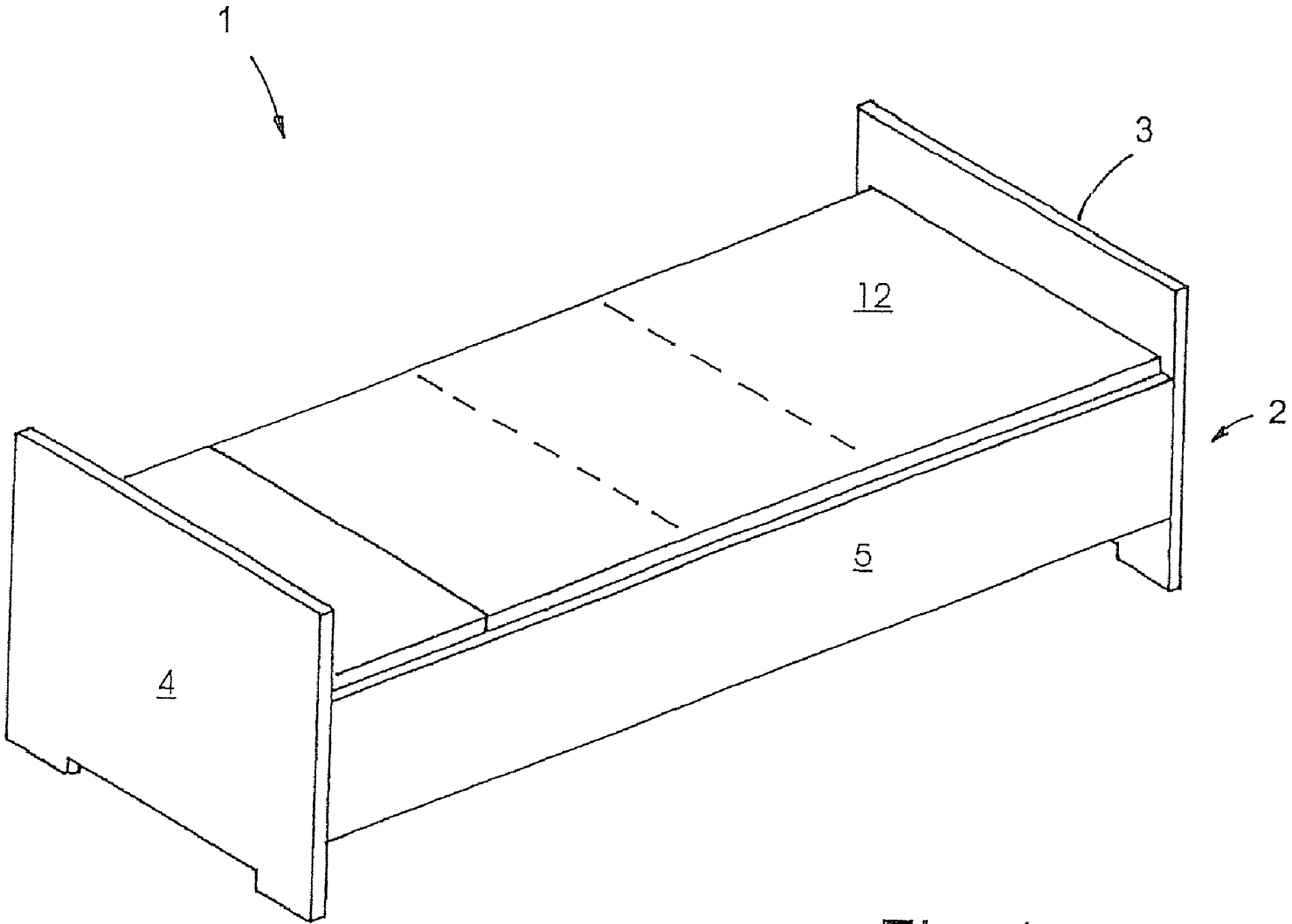
FIG. 1 is a perspective view of a treatment bed in a bed position in accordance with an embodiment of the invention.

While the invention is capable of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF THE PREFERRED EMBODIMENTS

Figure 2:
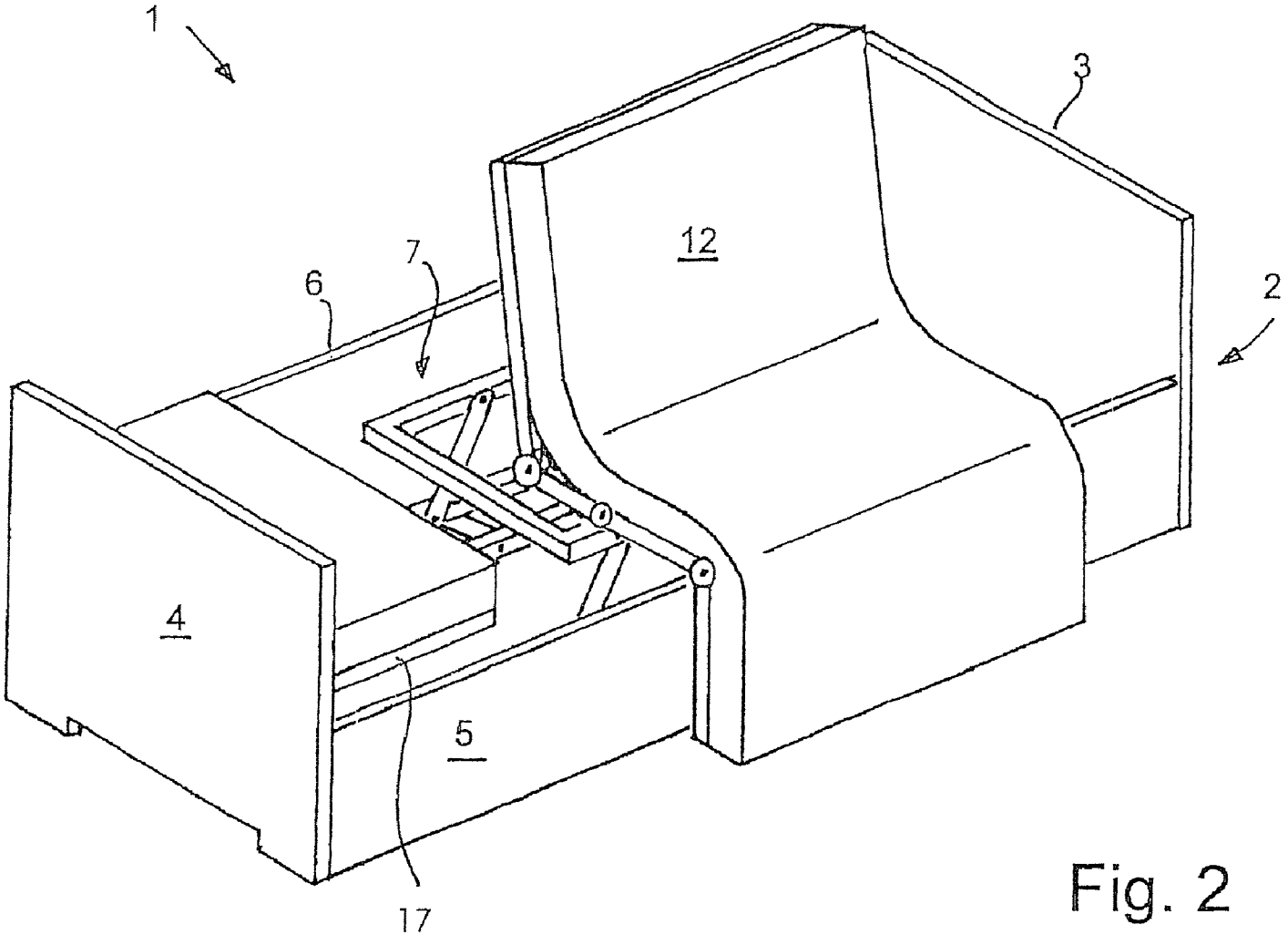
FIG. 2 is a perspective view of a treatment bed in a rotated armchair position in accordance with an embodiment of the invention.

FIG. 1 shows a perspective view of a treatment bed 1 in the position allowing the patient to lie down, while FIG. 2 shows treatment bed 1 in the seat or armchair position.

Treatment bed 1 has a bed edge 2 with a head part 3 and a foot part 4 as well as, side panels 5 and 6. As illustrated, side panel 5 facing the viewer is a distance away from the floor in the position for lying down, in which a gap exists between lower edge of the side panel 5 and the floor, making it possible for care-giving personnel to place the ends of their feet underneath the bed. Side panel 5 is movably mounted, and in the armchair position of the treatment bed 1, as shown in FIG. 2, moves downward. The special mounting of side panel 5 is described in detail in, for example, DE 199 12 937 A1.

Figure 3:
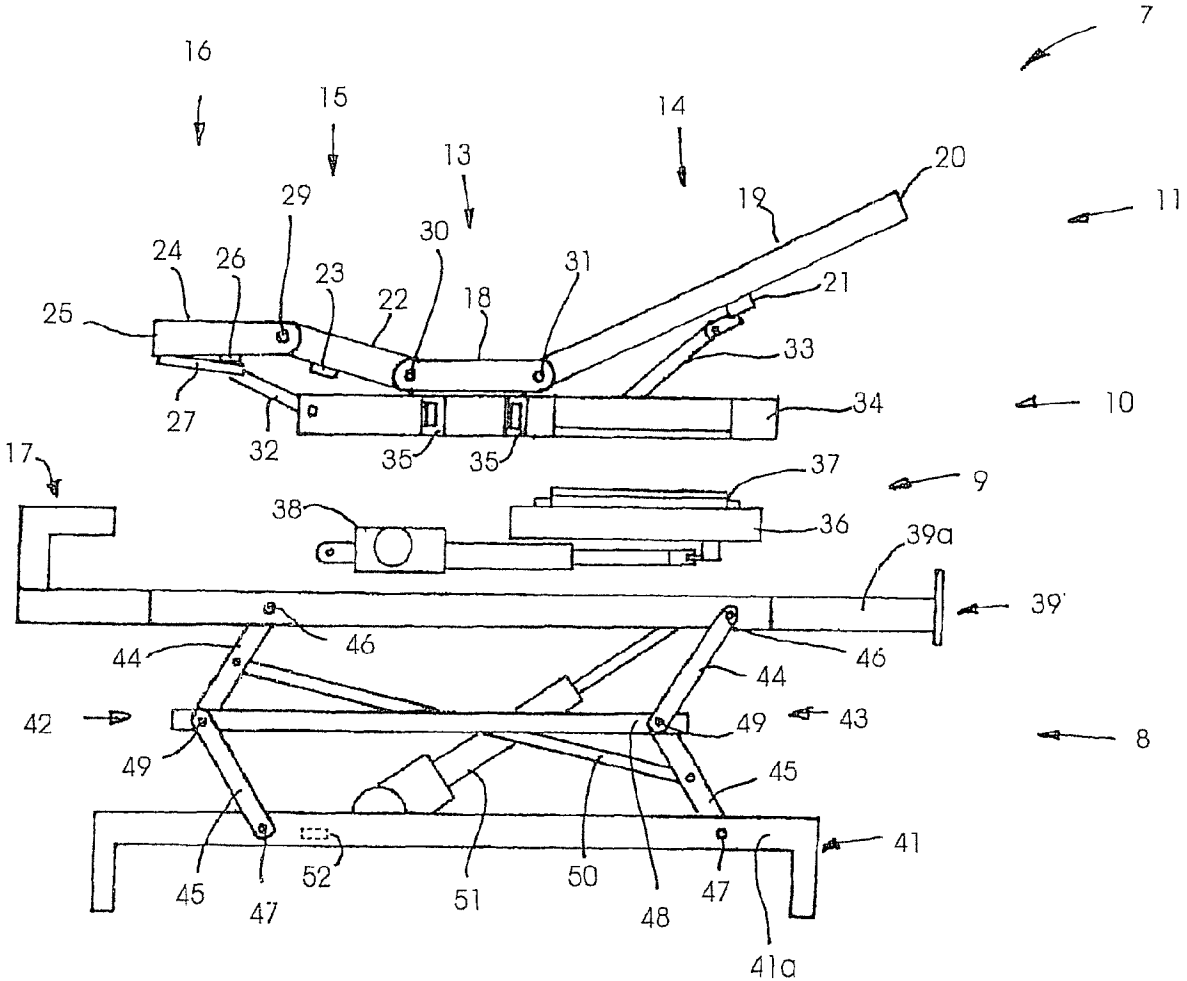
FIG. 3 is a side partly exploded view of the structure of a treatment bed lifter according to an embodiment of the invention.

Inside bed edge 2 is a bed lifter 7 as is recognizable in FIG. 3. Bed lifter 7 comprises a height-adjustable base 8, on top of which a turning unit 9 with a vertical axis of rotation is mounted, an intermediate frame 10, and a bed frame 11 on which a mattress 12 is situated. Bed frame 11 is rectangular in the plan view.

Bed frame 11 is divided into a central section 13, which is firmly connected to intermediate frame 10, a back section 14, which is articulated to central section 13, a thigh section 15, likewise articulated to central section 13, and a lower leg section 16. Lower leg section 16 is articulated to the end of thigh section 15 remote from central section 13. The hinge axes around which sections 14, 15, 16 are movable relative to central section 13, are horizontal. Finally, bed frame 11 comprises another foot section 17, which is directly connected to base 8.

The central section 13 of bed frame 11 has two mutually parallel side beams 18, separated from one another by a distance corresponding to the width of treatment bed 1. Only one side beam 18 is visible in the illustrated side view.

Back section 14 primarily comprises a beam 19 as well as an additional beam parallel to it (not shown). Beam 19 is hinged to beam 18, while the additional beam (not shown) of back section 14 is connected to the additional beam (not shown) parallel to side beam 18. The two beams 19 of back section 14 are connected by a cross beam (not shown) at the upper end at 20. In addition, another cross brace 21 connects the two side beams 19 at the lower side.

Thigh section 15 is also delimited by two side beams, of which one side beam 22 is shown. The other side beam is concealed by side beam 22. The two side beams 22 are connected by a cross brace 23. Cross brace 23 runs, for instance, roughly at the center of each side beam 22 on the lower surface.

Finally, lower leg section 16 is also delimited by two side beams, of which one side beam 24 is shown in the figure. The two side beams 24 are connected at lower end 25 by a cross brace (not shown). In addition to this cross brace, the two side beams 24 are connected by a brace 26, fixed to end 25 by two mutually parallel guide rails 27. As shown, guide rails 27 run at an angle to side beam 24 in such a way that they converge in the direction of foot end 25. The distance between the two guide rails 27 may be markedly smaller than the distance between the two side beams 24. The guide rails 27 are offset relative to the two side beams 24 by roughly 20 cm.

All side beams 18, 19, 22, and 24 bear pins pointing to the center of the bed for connecting molded rubber parts to side beams 18, 19, 22, and 24, which anchor, in a known manner, spring strips that extend over the width of bed frame 11. The hinges that connect respective adjacent side beams 18, 19, 22, 24 on each side of bed 1 are schematically represented at 29, 30 and 31.

Lower leg section 16 can be raised or lowered by an electric motor, not shown. The electric motor is coupled via a gear to a lever 32 and is situated in intermediate frame 10. An additional electric motor supported in intermediate frame 10 is coupled to a lever 33 connected to cross brace 21. In this way, back section 14 can be raised or lowered.

The two side beams 18 of central part 13 are rigidly connected to intermediate frame 10. Intermediate frame 10 consists of square tubes welded together into a rectangular frame, of which only one square tube 34 is shown. The square tube parallel to it is concealed by square tube 34.

The rectangular frame is narrower than would correspond to the distance of side beams 18 from one another. A total of four arms 35 are welded to mutually parallel square tubes 34, two of which are supported by each side beam 18. Arms 35 run horizontal to, and at a right angle to, the longitudinal axis of treatment bed 1.

Turning unit 9 connects intermediate frame 10 to height-adjustable base 8. It is composed of a ring 36 and a turntable 37 pivotably seated in ring 34. Turntable 37 is bolted to intermediate frame 10 with bolts, not shown. An exemplary structure of turning unit 9 is described in DE 102 50 075 A1, incorporated herein by reference.

By means of turning unit 9, intermediate frame 10 together with bed frame 11 is pivotable about a vertical axis of rotation. The rotation is accomplished by means of an electric motor 38, which is braced at one end on base 8 and at the other end on turntable 37.

Height-adjustable base 8 comprises an upper frame 39 as well as a lower frame 41, both consisting of square tubes appropriately welded together, of which two mutually parallel square tubes form side beams 39*a* and 41*a*. Upper frame 39 is supported on lower frame 41 by a total of four pairs of articulated levers 42 and 43. Turning unit 9 is connected to upper frame 39.

The pairs of articulated levers 42, 43 are each situated next to a long side of base 8, so that the corresponding pairs of articulated levers 42, 43 on the other long side are not recognizable in the side view of FIG. 3.

The pair of articulated levers 42, 43 consists of an upper articulated lever 44 and a lower articulated lever 45. Each articulated lever 42, 43 is articulated to upper and/or lower frame 39, 41 on the respective side of the bed by a hinge 46 having a horizontal axis. All axes of the hinges 46 are axially parallel to one another. The axes of hinges 46 are coaxial with the axes of the hinges of articulated levers 42, 43, not shown. Hinges 47 connect the pairs of articulated levers 42, 43 to lower frame 41. The axes of hinges 47 are parallel to the axes of hinges 46.

The two pairs of articulated levers 42, 43 on each side of base 8 are coupled to one another by an associated horizontal coupling strut 48. Each coupling strut 48 is, as shown, connected in a hinge-like manner to knee joint 49 of each pair of articulated levers 42, 43.

Finally, a diagonally-running coupling strut 50 connects upper articulated lever arm 44 of the pair of articulated levers 42 to lower articulated lever arm 45 of the pair of articulated levers 43 on each side of base 8. The articulated levers 45 on both sides of the bed at the foot end may be connected by a shaft, not shown. Similarly, the two lower articulated levers 45 may be connected at their top end as well.

An electric lifting motor 51 which, like electric motors 33, 38, may be implemented as a spindle motor, extends between upper frame 39 and lower frame 41. It is articulated next to articulated lever 42 on a cross brace 52, indicated by dashed lines, of lower frame 41. Its other end is hinged onto a concealed cross brace of upper frame 39 next to articulated lever 43. The motor lies between the two frames 39 and 41, and is thus transverse to diagonal coupling strut 50. Another lifting motor (not shown) is arranged parallel to the visible lifting motor 51 and is articulated in the same way. Both lifting motors operate in parallel kinematically and are arranged as closely together as possible.

Articulated levers 42, 43 cooperate with horizontal coupling strut 48 and diagonal coupling strut 50 as a guide for the relative motion of the two frames 39 and 41.

The lifting mechanism of lifter 8 is itself very rigid. Because of the directly adjacent arrangement of the two lifting motors 51, differential thrusts, and thus torsions, between the lifting motors can very easily occur, even if only small movement differences arise. A further difficulty is that the two lifting motors 51 are spindle motors, which by their nature are self-locking and are able to produce very large forces.

Even if the lifting motors are initially aligned, it is practically impossible to prevent differences in running speeds from developing, due to the tolerances of the lifting motors. This leads in the course of the time to a difference in lift between the two lifting motors.

Figure 4:
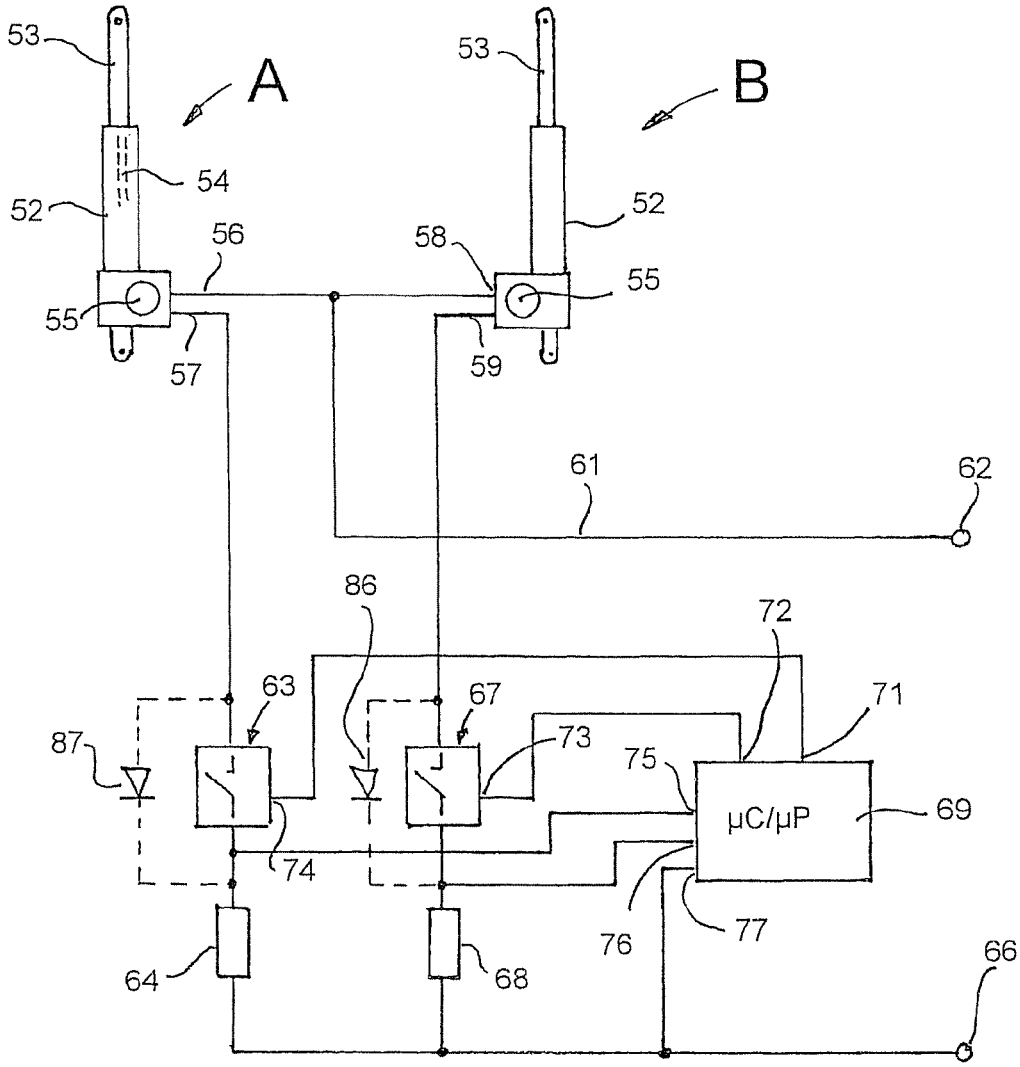
FIG. 4 is a schematic diagram of a basic circuit for balancing the load distribution on the two lifting motors according to an embodiment of the invention.

In order to balance the lifting motors in operation such that each of the two lifting motors contributes about equally to the total lifting force, the balancing circuit represented as a schematic diagram in FIG. 4 is provided. In FIG. 4, the two lifting motors operating in parallel mechanically are labeled A and B. Each lifting motor has an outer telescoping tube 52 as well as an inner telescoping tube 53 that can be set in rotation via a rotating threaded spindle 54, drawn in dashes in FIG. 4, in order to displace inner lifting tube 53 axially in relation to outer telescoping tube 52. An electric motor 55 mounted at one end of outer lifting tube 52 drives threaded spindle 54 via a worm gear.

The lifting motor A has two power supply inputs 56 and 57, via which power is supplied within the low voltage range of around 24-48 V in the illustrated embodiment. Lifting motor B has the same structure in principle, which is why the same reference symbols are used there to designate the mechanical components. Lifting motor B is supplied with power via power supply inputs 58 and 59. The two power supply inputs 56 and 58 are connected in parallel and lead via a line 61 directly to a connecting terminal 62. Terminal 57 leads to a controlled semiconductor switch 63 and from there to a current-sense resistor 64, and via a line 65 to an additional power supply input 66.

The connection of power supply input 59 is similar. Power supply input 59 is connected via a controlled semiconductor switch 67, from where the power connection leads via a current-sense resistor 68 to line 65, and thus to power supply input 66. The two semiconductor switches 63, 67 are controlled by a microprocessor/microcontroller 69. The latter has two outputs 71 and 72, which are connected to control inputs 73 and 74 of the two semiconductor switches 63 and 67.

In addition, the microprocessor 69 is connected at inputs 75, 76 in series with current-sense resistors 64 and 68 and at input 77 in parallel to current-sense resistors 64 and 68. For this purpose, one input 77 is connected to line 65, while input 76 is connected to the node between current-sense resistor 68 and semiconductor switch 67. The input 75 is accordingly connected to current-sense resistor 64.

Behind the two inputs 75 and 76, there are analog/digital converters in microprocessor 69, which are able to convert the voltage measured at current-sense resistor 64 and 68 respectively into digital values that can be processed by the program in microprocessor 69.

The corresponding controlled output of a higher-order control circuit (not shown), with which, using a conventional manual push-button, the user can cause the two lifting motors A and B to run in the direction of lifting or lowering, depending on the actuation, is connected to power supply inputs 62 and 66. When the button is released, the power supply to inputs 62 and 66 is switched off and lifting motors A and B remain self-locked in their respective positions. The power supply of microprocessor 69 is not shown, since it is obvious to those skilled in the art and is not the subject matter of the invention.

Figure 5:
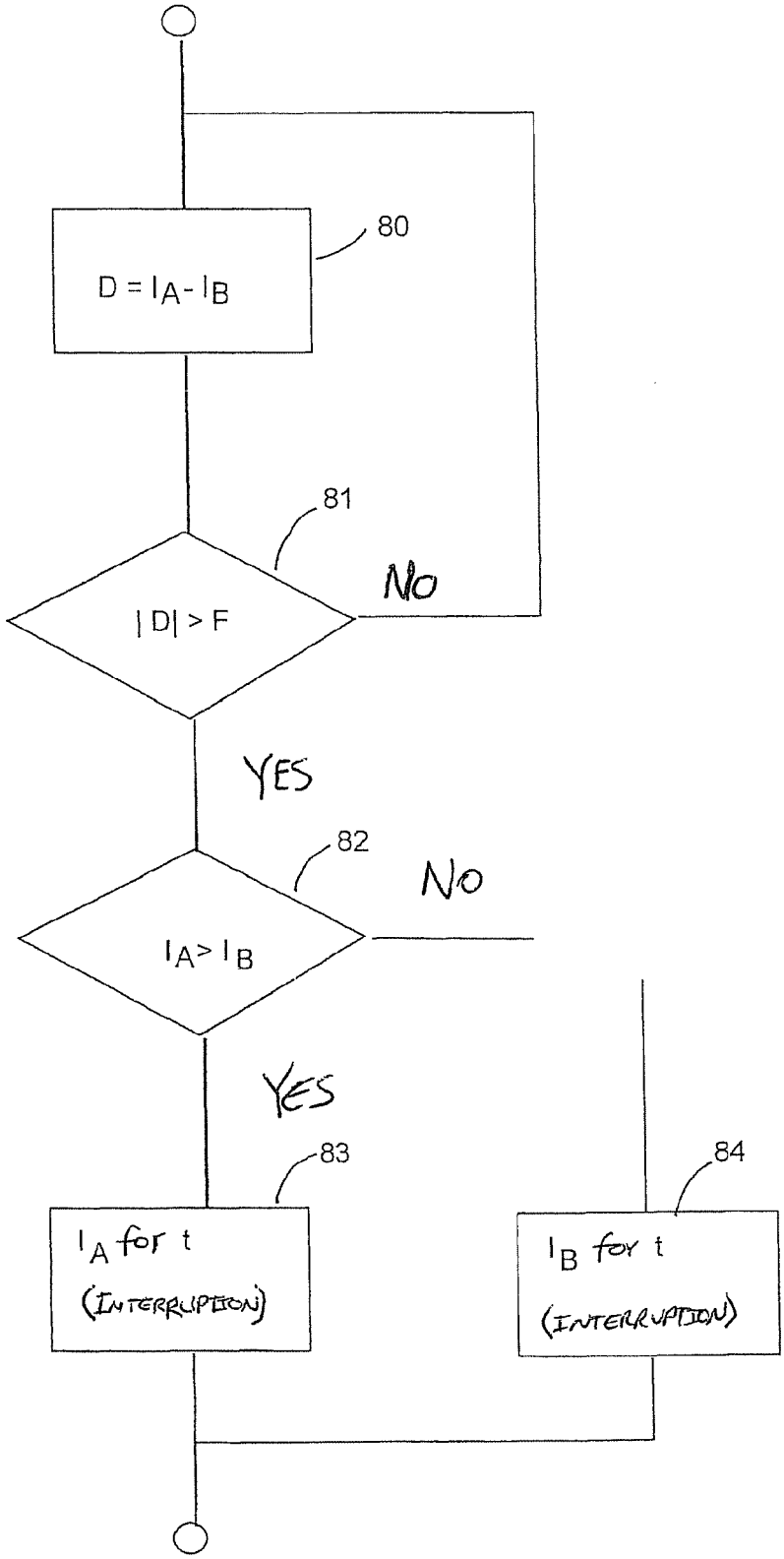
FIG. 5 is a flow chart of a process for balancing the load distribution of the treatment bed during a lifting operation.

The mode of operation of the balancing circuit shown above will be explained in connection with the flow chart of FIG. 5. If the user would like to raise the treatment bed, he presses the appropriate command button on his manual control. A voltage is thereby supplied via the central control unit to the two power supply inputs 62 and 66. For example, the positive pole is connected to power supply input 66 in this mode of operation, while the negative pole is connected to power supply input 62.

In the idle state of the circuit, with microprocessor 69 activated, it supplies electrical signals at its outputs 71 and 72, which ensure that the two semiconductor switches 63 and 67, implemented as power MOSFETs for example, are conducting.

Thus a current begins to flow that runs from power supply input 66 via current-sense resistor 68 and conducting semiconductor switch 67 to lifting motor B, and from there to power terminal 62. Another current flows from power supply input 66 via resistor 64 and semiconductor switch 63 to lifting motor A, and from there to power supply input 62.

The currents flowing to each of the lifting motors A and B are detected continuously by the microprocessor 69 individually with the aid of current-sense resistors 64 and 68.

In an execution block 80, microprocessor 69 forms the difference of the currents $I_A$ and $I_B$ drawn by lifting motors A and B on the basis of the voltages that are detected at the two resistors 64 and 68. In a decision block 81 it is then determined whether the magnitude of the current difference D is greater than a preset error value F. If this is not the case, the program of the microprocessor 69 returns, via a short waiting loop, if necessary, to the start of execution block 80

Otherwise, if the magnitude of the difference D exceeds the preset limit value F, the program continues at decision block 82. In decision block 82, it is determined whether current $I_A$ is larger than current $I_B$.

If current $I_A$ is larger than $I_B$, this an indication that lifting motor A is contributing more to the lifting force than lifting motor B. It is assumed that the lifting force of the lifting motors is proportional to the current drawn, since the two lifting motors are otherwise dimensioned and constructed identically within component tolerances.

If lifting motor A is drawing more current, this is an indication that it is leading the other lifting motor B, which at the same time implies a certain torsion in lifter 8, which is generally undesirable. The program therefore executes instruction block 83, which ensures that the current for lifting motor A is interrupted for a preset time t. For this purpose, microprocessor 69 supplies a signal at its output 71 that brings semiconductor switch 63 into the blocking state. The time t lies in the range between 0.01 sec. and 2 sec. The optimal value is to be determined empirically. Upon completion of the time t, the program continues at the input of an instruction block 80.

After the execution of decision block 81, if it turns out after the check in decision block 82 that current $I_A$ is smaller than current $I_B$, the program branches to an instruction block 84, which leads microprocessor 69 to interrupt current $I_B$ for the duration of time t. For this purpose, microprocessor 69 supplies a signal at its output 82, by which semiconductor switch 67 is blocked for the time t. After executing instruction block 84, the program likewise returns to input instruction block 80.

The time t is selected such that, by repeated execution of instruction blocks 83 or 84, currents $I_A$ and $I_B$ approximate one another. If after the interruption of power for one or the other lifting motor A or B, the power drawn reverses significantly, i.e. by more than the value F, time t may be deemed to be too long, On the other hand, in practice, currents $I_A$ and $I_B$ might not and need not ever precisely equal one another since there is a certain residual error even with a small setting of t, but any small remaining difference in the currents is harmless. Therefore, t should be selected in such a way that instruction blocks 83 and 84 are not constantly being executed one after the other because, for instance, the opposite error is present after execution of, for example, instruction block 83, and the error difference current has now become greater than tolerance value F.

The magnitude of t should also be matched to the duration of the program execution cycle, so that a balance between lifting motors A and B arises as quickly as possible.

By briefly cutting off the lifting motor current by way of microprocessor 69, the lifting motor is briefly stopped at the same time, so that the other lifting motor, still supplied with current, can catch up.

After a finite number of program runs, a condition is reached in which both lifting motors A and B draw about the same current and thus produce approximately the same thrust force. At the same time, this also means that no torsion arises in the frame itself or that one lifting motor must drag the other motor. If the error again increases over time due to differences in rpm, it will be compensated automatically by the balancing circuit.

In order to reach such balance as quickly as possible, in an embodiment of the invention both the magnitude of the preset permissible current difference F and the turn-off time t are dependent on the measured currents.

If it is not desired for the control to intervene when lifting motors A and B are set in motion in the direction of lowering, the two semiconductor switches 63 and 67 can be shunted by diodes 86 and 87, as indicated in broken lines.

If the program is to be effective during lowering, however, diodes 86 and 87 are not used, but rather semiconductor switches 63 and 67, which conduct current in both directions. If desired, this can also be achieved by MOSFETs connected back-to-back. Suitable circuitry measures for this purpose are known to those in the art and need not be described. As noted above, a control circuit for reversing the polarity of the current supplied to the electric motors may be located between the power source and the balancing circuit.

Depending upon construction and conditions, it may be that balance can only be achieved in the lowering operation if the current is interrupted to the motor which is drawing less current, not that which is drawing more, as is the case for lifting. During the lowering operation, the force acting at lifting tube 53 supports the rotational motion of the armature; in other words, the lagging motor is the one that is most strongly loaded by the weight. During the lowering operation in this alternative embodiment of the invention, a program corresponding to that of FIG. 5 is executed, with the > sign used in decision block 82 replaced by a < sign.

Finally, it is conceivable that conditions may vary during the lowering operation. Thus, during the lowering operation the output of the two instruction blocks 83 and 84 may be monitored to determine whether the current difference measured in instruction block 80 became larger after they were executed. For this purpose, an appropriate additional query block can be inserted, which will then have the effect that the > sign will be dynamically exchanged with the <, or vice versa, in query block 82. In this way, the arrangement becomes self-learning and briefly switches off the current to the lifting motors so that the currents in both lifting motors A and B become essentially equal in magnitude and are kept essentially equal.

The invention claimed is:

1. An adjustable bed comprising:

a height-adjustable lifter;

first and second electric motors for adjusting the height-adjustable lifter;

a power source for supplying the first and second electric motors; and a balancing circuit, the balancing circuit adapted to detect first and second current inputs for the first and second electric motors respectively, compare the first and second current inputs to one another, and, if the first and second electric motors are being controlled for lifting the treatment bed, interrupt for a fixed time t the supply of power to a selected one of the first and second electric motors whose current consumption is larger than that of the other of the first and second electric motors.

2. An adjustable bed according to claim 1, wherein the first and second electric motors comprise a threaded spindle shaft.

3. An adjustable bed according to claim 1, wherein the first and second electric motors are permanently excited DC motors.

4. An adjustable bed according to claim of 1, further comprising a control circuit between the power source and the balancing circuit for reversing the polarity of the current supplied to electric motors.

5. An adjustable bed according to claim 4, wherein the control circuit is provided with a manual control switch, by way of which, from the off state, the power to the first and second electric motors can be switched on in one of two polarities.

6. An adjustable bed according to claim 5, wherein the control circuit has only a common current output for the first and second electric motors.

7. An adjustable bed according to claim 1, wherein the balancing circuit comprises one power supply input and first and second outputs, wherein the first and second electric motors are connected to the first and second outputs respectively.

8. An adjustable bed according to claim 1, wherein the balancing circuit is further adapted to interrupt for the fixed time t the power input to a selected one of the first and second electric motors whose current consumption is smaller than that of the other of the first and second electric motors if the first and second electric motors are being controlled for, lowering the treatment bed.

9. An adjustable bed according to claim 1, wherein the balancing circuit is further adapted to interrupt for the fixed time t the power input to a selected one of the first and second electric motors whose current consumption is higher than that of the other of the first and second electric motors if the first and second electric motors are being controlled for lowering the treatment bed.

10. An adjustable bed according to claim 1, wherein the balancing circuit is further adapted to determine whether the difference between the first and second current inputs after the interruption of power is less than the difference between the first and second current inputs before the interruption of power, and to selectively interrupt power to one of the first and second motors for a predetermined period if the examination is positive.

11. An adjustable bed according to claim 1, wherein the interruption of the supply of power to the selected one of the first and second electric motors takes place for the fixed time t only if the difference between the first and second current inputs is greater than a fixed window value F.

12. An adjustable bed according to claim 1, wherein the window value F is dependent on one or both of the first and second current inputs.

13. An adjustable bed according to claim 1, wherein the fixed interruption time t is between 0.01 seconds and 2 seconds.

14. A method of balancing currents to first and second electric motors for actuation in an adjustable bed comprising:

detecting first and second current inputs for the first and second electric motors respectively;

comparing the first and second current inputs to one another; and interrupting for a fixed time t the supply of power to a selected one of the first and second electric motors whose current consumption is larger than that of the other of the first and second electric motors if the first and second electric motors are being controlled for lifting the treatment bed.

15. A method according to claim 14, wherein the first and second electric motors comprise a threaded spindle shaft.

16. A method according to claim 14, wherein the first and second electric motors are permanently excited DC motors.

17. A method according to claim 14, wherein the step of interrupting is executed via a balancing circuit, and wherein the balancing circuit comprises one power supply input and first and second outputs, wherein the first and second electric motors are connected to the first and second outputs respectively.

18. A method according to claim 14, further comprising interrupting for the fixed time t the power input to a selected one of the first and second electric motors whose current consumption is smaller than that of the other of the first and second electric motors if the first and second electric motors are being controlled for lowering the treatment bed.

19. An adjustable bed according to claim 14, wherein the interruption of the supply of power to the selected one of the first and second electric motors takes place for the fixed time t only if the difference between the first and second current inputs is greater than a fixed window value F.

* * * * *